US007270575B2

(12) United States Patent
Krantz, Jr. et al.

(10) Patent No.: US 7,270,575 B2
(45) Date of Patent: Sep. 18, 2007

(54) CIRCUIT BOARD AND SOCKET ASSEMBLY

(75) Inventors: Leonard A. Krantz, Jr., Girard, PA (US); Joseph D. Magnan, South Kortright, NY (US)

(73) Assignee: Amphenol Corporation, Wallingford, CT (US)

( * ) Notice: Subject to any disclaimer, the term of this patent is extended or adjusted under 35 U.S.C. 154(b) by 686 days.

(21) Appl. No.: 10/364,556

(22) Filed: Feb. 12, 2003

(65) Prior Publication Data

US 2004/0157500 A1 Aug. 12, 2004

(51) Int. Cl.
*H01R 13/66* (2006.01)

(52) U.S. Cl. ..... 439/620.15; 439/82; 439/871

(58) Field of Classification Search ..... 439/620, 439/82, 871, 853, 848
See application file for complete search history.

(56) References Cited

U.S. PATENT DOCUMENTS

| | | | | |
|---|---|---|---|---|
| 3,621,445 A | | 11/1971 | Horecky | 339/17 |
| 4,050,772 A | | 9/1977 | Birnholz et al. | 339/220 |
| 4,374,607 A | | 2/1983 | Bright et al. | 339/253 |
| 4,515,422 A | * | 5/1985 | Pritulsky | 439/82 |
| 4,701,004 A | | 10/1987 | Yohn | 439/871 |
| 4,720,268 A | | 1/1988 | Weiss | 439/82 |
| 4,799,904 A | | 1/1989 | Sutcliffe | 439/733 |
| 4,930,200 A | * | 6/1990 | Brush et al. | 29/25.42 |
| 5,101,322 A | * | 3/1992 | Ghaem et al. | 361/715 |
| 5,456,616 A | * | 10/1995 | Fuerst et al. | 439/620 |
| 5,885,113 A | | 3/1999 | Bricaud | 439/733.1 |
| 6,247,965 B1 | | 6/2001 | Cummings et al. | 439/587 |

* cited by examiner

*Primary Examiner*—Tho D. Ta
(74) *Attorney, Agent, or Firm*—Blank Rome LLP

(57) ABSTRACT

An interconnect device and electrical signal filtering connector is disclosed that does not require soldering. The interconnect device is an electrical contact that has a proximate or forward end with a cavity for receiving an electrical conductor of a first plug, and a distal or rear end, also called a tail, formed with a circumferentially-arranged undercut that engages the ends of one or more electrically conducting flanges that extend radially inward in a contact receptacle of a printed circuit board. The connector can be a male plug or female receptacle, including a receptacle with front and rear shells and an insert slidably engaged inside the shells, the receptacle adaptable for receiving a round, 14-conductor plug. The printed circuit board assembly includes a printed circuit board with one or more contact receptacles.

27 Claims, 3 Drawing Sheets

CIRCUIT BOARD AND SOCKET ASSEMBLY

BACKGROUND OF THE INVENTION

1. Field of the Invention

The present invention relates generally to electrical connectors. More particularly, the present invention relates to a method of and system for interconnecting a printed circuit board to the rear of an electrical socket or plug.

2. Description of the Prior Art

Present methods of and systems for terminating a printed circuit board to the rear of an electrical socket or plug connector include soldering the connector contact tails to the board. The purpose of the soldering operation is to provide electrical and mechanical connection. In some instances, the heat generated by the soldering process can adversely effect the connector and printed circuit board. As a result, the electrical performance of the interconnect can be irreparably destroyed or, at the least, significantly degraded. Performance degradation, of course, must be avoided in electronics devices that are used in avionics and other sensitive systems, especially where rigid specifications must be met.

Moreover, soldering can create a rigid connection between the components. When a member soldered to a printed circuit board is deformed due to tensile, compressive or torque forces acting on the member, those forces can be propagated or transferred into the substrate of the printed circuit board causing internal stress. The stress can then damage the substrate or the crystal lattice structure associated with the circuits on the printed circuit board resulting in damage to the device.

The present method solves the problems associated with soldering and rigid connections by providing an interconnect between a socket and a printed circuit board whereby the means for attaching the two components together is made without soldering or using other methods involving heat. Moreover, the present invention solves that problem without introducing new problems, such as causing internal stresses in the printed circuit board that can also result in performance degradation.

Solderless interconnects are not new. U.S. Pat. No. 4,799,904 to Sutcliffe, for example, discloses a cylindrical connector contact for an electrical socket that can be mated to a printed circuit board. The contact, like in the present invention, provides the means for attaching the socket to the printed circuit board. The contact is made of a conducting material so that there is electrical continuity between an electrical conductor inserted in the front end of the contact and the circuits on the printed circuit board. In Sutfliffe, the contact has a plurality of axially spaced "barbs" arranged in a purely circumferential direction on the distal or "tail" portion of the contact. Those barbs engage rings on the wall of a circuit board through hole thereby retaining the contact within the hole. The larger the diameter of the hole, the greater the number of rings and barbs that are needed to ensure adequate mechanical attachment. Sutcliffe teaches that at least two barbs and rings are required to achieve a stable electrical contact. To allow for dimensional tolerances to be relaxed, the tail includes an axial cut so that the tail portion becomes flexible, which could reduce internal stresses on the printed circuit board at the connection point.

There are several problems associated with the contact disclosed in Sutcliffe. First, it is difficult and expensive to manufacture barbs and rings with tolerances in the order of a few hundredths of an inch. Moreover, if the contact is inserted in the printed circuit board through hole too far, only one barb and ring may make contact, reducing the electrical continuity between the two components and also lowering the mechanical forces retaining the contact in the hole. Further, only a portion of barb actually makes contact with a ring inside the hole, which limits the amount of electricity that can be conducted between the two parts.

U.S. Pat. No. 4,374,607 to Bright et al. also discloses an interconnect that does not require soldering but, unlike Sutcliffe, uses axially spaced "undercuts" or teeth on the distal or tail portion of a pin contact to mate with corresponding axially spaced grooves on a socket. When inserted, the undercuts engage and retain the contact in the socket.

The problem with the pin contact disclosed in Bright et al. is that electrical conductivity is made at the very distal end of the contact, which would not be feasible if it were used to conduct electricity to a printed circuit board. Pin contacts used for printed circuit boards generally require electrical contact at or near the same point where mechanical attachment occurs. That type of connection is preferred in many cases because the tensile and compressive forces transmitted through the contact to the printed circuit board must be minimized, as noted above, to reduce internal stresses on the board. Internal stresses can damage the crystal structure of, for example, the logic circuits on the board and cause circuit failure.

U.S. Pat. No. 4,701,004 to Yohn discloses a solderless cylindrical retention clip for receiving an electrical contact pin of an electrical connector. The clip is inserted inside a bore hole. One end of the clip includes two cantilevered springs or lances projecting radially inward toward the longitudinal axis of the clip. The ends of the springs engage a shoulder or groove formed on a pin. The shoulder extends perpendicular to the longitudinal axis of the pin (i.e., radially).

One obvious problem with the retention clip disclosed in Yohn is that it is not designed to conduct electricity. So while a contact inserted in the clip is retained and prevented from moving in a direction longitudinal to the contact axis, no electrical signals are conducted through the clip to another system.

U.S. Pat. No. 4,050,772 to Birnholz et al. discloses a contact pin and printed circuit board through hole receptacle for receiving the contact and conducting electricity. The through hole receptacle includes a rectangular lip around the opening of the hole and an annular electrical contact surrounding the opening of the hole. Together, those components engage the rear shoulder of a flange at the top of a contact pin as it is inserted in the hole. Another portion of the through hole inside the hole engages a radially-extending shoulder of a barb on the shank of the contact.

The problem with the contact pin disclosed in Birnholz et al. is that the rigid metal barb of the contact forces the plastic hole apart during insertion of the contact. That can cause internal stresses within the printed circuit board in the vicinity of the through hole that can damage the performance of the device. Also, the contact through hole receptacle forms a rigid connection with the contact, which is disadvantageous in some applications as noted previously.

The various approaches described in the above-cited patents for making solderless interconnects have not been found to be totally satisfactory solutions. This is especially true in the context of electrical interconnects used in highly demanding applications like aircraft connectors.

SUMMARY OF THE INVENTION

In view of the foregoing, it should be apparent that there still exits a need in the art for a method and apparatus for electrically interconnecting an electrical socket and a printed circuit board in which there is good conductivity and retention between those components and wherein the means for interconnecting does not degrade the electrical performance of the device. It is, therefore, a primary object of this invention to provide a method and apparatus for interconnecting a printed circuit board to the rear of an electrical socket that does not require soldering or other methods involving heat.

More particularly, it is an object of this invention to provide a conducting contact or pin associated with an electrical socket that extends into and engages a conducting through hole on a printed circuit board without the need for soldering.

Still more particularly, it is an object of this invention to provide a conducting contact or pin associated with an electrical socket that extends into and engages a conducting through hole on a printed circuit board so that external forces acting on the socket or plug are not transferred through the contact point to the printed circuit board or vice versa and thereby cause damage to the device.

Another object of this invention to provide a contact receptacle in a printed circuit board through hole that has springs or flanges for engaging an undercut on a contact when the contact is inserted in the contact receptacle.

A further object of the present invention is to provide a contact insertable in a contact receptacle in a printed circuit board in which the point where those components touch provides longitudinal retention of the contact in the receptacle and also provides electrical continuity between the components.

Still another object of the present invention is to provide a contact and contact receptacle in a printed circuit board in which the contact minimizes the transfer of internal stresses between the electrical socket and the printed circuit board.

Briefly described, these and other objects of the invention are accomplished in accordance with its apparatus aspects by providing a contact associated with an electrical socket receptacle or plug assembly and a contact receptacle associated with a through hole on a printed circuit board assembly. Thus, the contact can be associated with either a plug or a socket. In either case, the contact has a proximate or front end with a cavity for receiving an electrical conductor of a plug, and a distal or rear end, also called a tail, formed with a circumferentially arranged undercut that engages the ends of one or more electrically conducting flanges that extend radially inward in the contact receptacle. The receptacle assembly can be any receptacle, including one adaptable for receiving a round, 14-conductor plug, and includes a front and rear shell and an insert slidably engaged inside the rear shell. The printed circuit board assembly includes a printed circuit board with one or more contact receptacles, rear insert, retainer spring, and chip capacitor board.

With these and other objects, advantages and features of the invention that may become hereinafter apparent, the nature of the invention may be more clearly understood by reference to the following detailed description of the invention, the appended claims and to the several drawings attached herein.

DETAILED DESCRIPTION OF THE INVENTION

Figure 1:
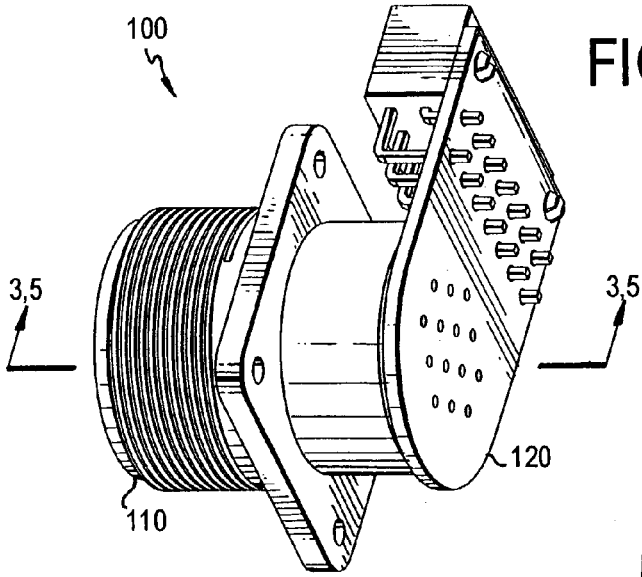
FIG. 1 is a perspective view of the connector of the present invention.

Referring now in detail to the drawings, wherein like parts are designated by like reference numerals throughout, there is illustrated in FIG. 1 a perspective view of the electrical connector 100 of the present invention having receptacle assembly 110 and printed circuit board assembly 120 in mating contact. The connector 100 in FIG. 1 illustrates how a socket and printed circuit board embodiment of the invention could be used in a typical application. It will be appreciated by one of ordinary skill in the art to which the invention pertains, however, that any connector involving the interconnection of a socket receptacle, pin receptacle or a plug and a printed circuit board is contemplated by the present disclosure and the invention can be used in many environments benign or severe as in aircraft. For example, the socket receptacle embodiment illustrated in FIG. 1 can be adaptable to receive a plug of any shape, not just round ones.

In the context of the present invention, the word "socket" can be interchanged with "adapter" or "receptacle." Those terms, and others commonly used in the art, refer generally to the female portion of an electrical interconnect. The word "plug" generally refers to the male portion of an electrical interconnect, although other terms are often used, including the general term "connector." However, "connector" also refers generally to a physical connection or mating of electrical components. It is important to note that a receptacle or a plug can contain pin or socket contacts. The embodiment of the connector 100 illustrated in FIG. 1 has a socket contact in a receptacle connector.

Figure 2:
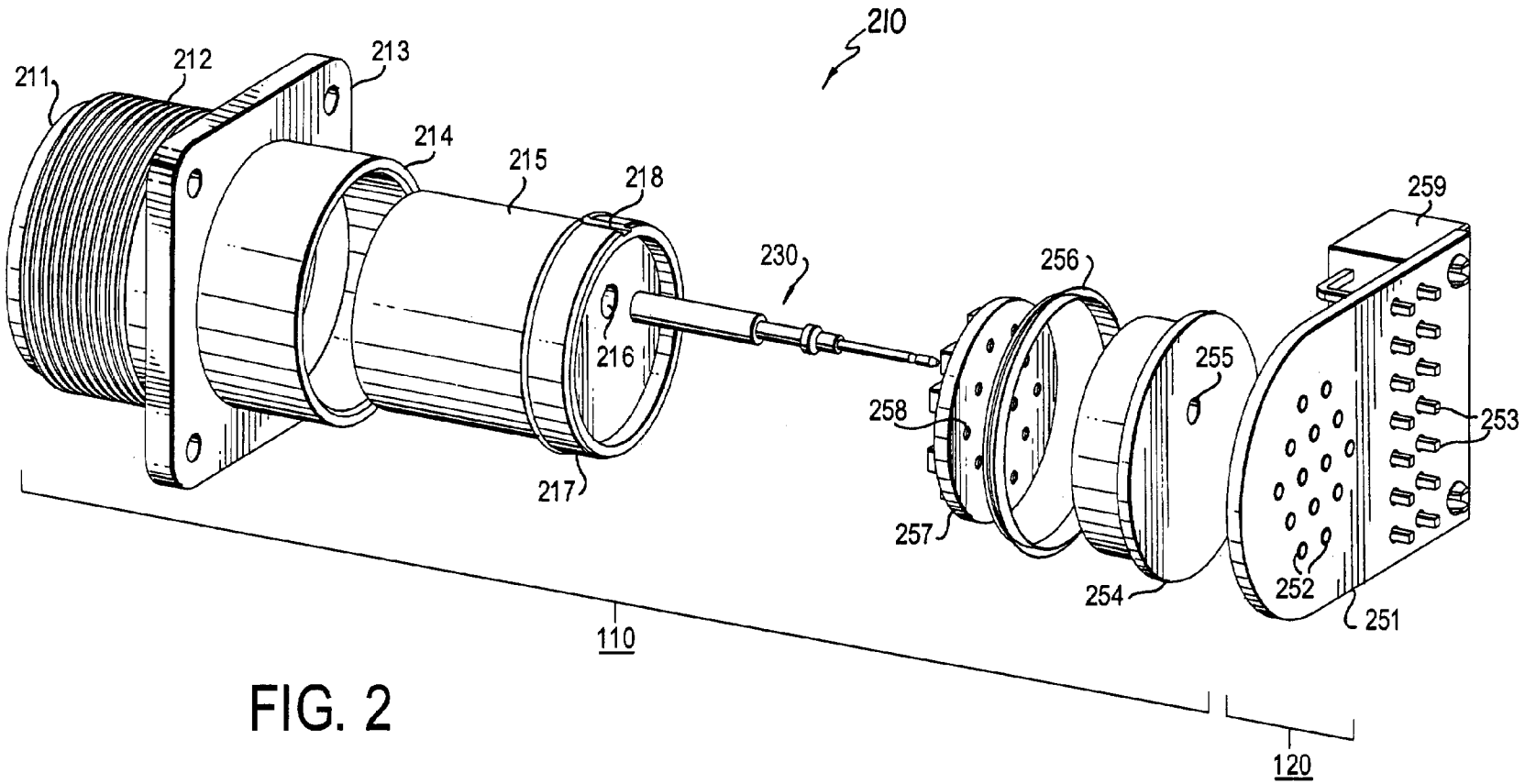
FIG. 2 is an exploded perspective view of the connector of the present invention showing its individual assembly components.

In FIG. 2, there is illustrated an exploded perspective view of the electrical connector 100 of FIG. 1 showing the individual assembly components of the receptacle assembly 110 and printed circuit board assembly 120. The receptacle assembly 110 includes a receptacle 210 and a contact 230. The printed circuit board assembly 120 includes a printed circuit board 251 and, in the embodiment shown, a printed circuit board plug receptacle 259. In FIG. 2, the assembly of components shown forms an electrical filter connector having a total capacitance of up to about 100,000 picofarads.

The components of the receptacle 210 include the following. First, the receptacle 210 has an opening 211 at a front end that is substantially cylindrical. In the embodiment shown in FIG. 2, the cylindrical opening 211 is designed to receive a plug size 20 in accordance military specification standard MIL-C-5015. However, the opening 211 may be any other size and shape in accordance with other standards.

Next, the receptacle 210 includes a cylindrical, threaded front shell 212 that forms the opening 211. Obviously, the front shell 212 does not have to be threaded, as any method of attaching a plug to the shell 212 is contemplated, including, but not limited to, the use of a clamp ring (not shown). The front shell 212 is axially-aligned with a rear shell 214. The front shell 212 and rear shell 214 are axially separated by a flange 213 interposed between those components. In FIG. 2, the flange is rectangular; however, a different shaped flange could also be used, depending on the specific application in which the connector 100 is used (in some cases, no flange may be required). Preferably, the front shell 212, flange 213 and rear shell 214 are made of one piece nickel plated aluminum alloy.

Next, the receptacle 210 includes a socket insert 215, which in FIG. 2 is shown as a cylinder with at least one longitudinally-extending contact hole 216 (only the rear opening of the hole 216 is shown). The socket insert 215 is slidable inside the front and rear shells 212, 214 and aligned axially in the shells 212, 214 by an insert retainer shoulder 217 located at the distal or rear end of the socket insert 215. The retainer shoulder 217 has a slightly larger diameter than the socket insert 215 and includes an alignment groove 218 that engages an axially-extending flange (not shown) on the top inside surface of the rear shell 214. Thus engaged, the alignment grove 218 prevents the socket insert 215 from rotating in a circumferential direction inside the shells 212, 214. As described in more detail below, a heat activated adhesive is applied to shoulder 217 and cured in an oven to stabilize and fix the socket insert 215 in place preventing rearward movement. A rear insert seal 254 (discussed below) prevents the socket insert 215 from backing out of the rear shell 214 after assembly.

As noted above, socket insert 215 includes at least one contact hole 216 (described below), for receiving a contact. The socket insert 215 will have one contact hole 216 for each electrical conductor associated with a mating plug (not shown). In FIG. 2, only one contact hole 216 is shown for clarity.

Next, the receptacle 210 includes a chip capacitor board 257. A retainer spring 256 is axially-aligned with and secures the chip capacitor board 257 to the rear of the socket insert 215. The retainer spring 256 also grounds the chip capacitor board 257 to the rear shell 215, which is preferably made of metal or metal allow so as to be electrically conductive. As shown in FIG. 2, the chip capacitor board 257 includes one or more apertures 258. There will be one aperture 258 axially-aligned with each contact hole 216 in the socket insert 215. Furthermore, each aperture 258 will contain a spring 308 (FIG. 3) that makes contact with the contact 230 and the conductive surface in the aperture 258. Selected holes in the chip capacitor board 257 will have a chip capacitor attached between each aperture 258 and the printed circuit board ground. Some apertures 258 may be in direct contact with a printed circuit board ground or have no plating in aperture 258 with no connection to the printed circuit board. These will be feed-through circuits.

Figure 3:
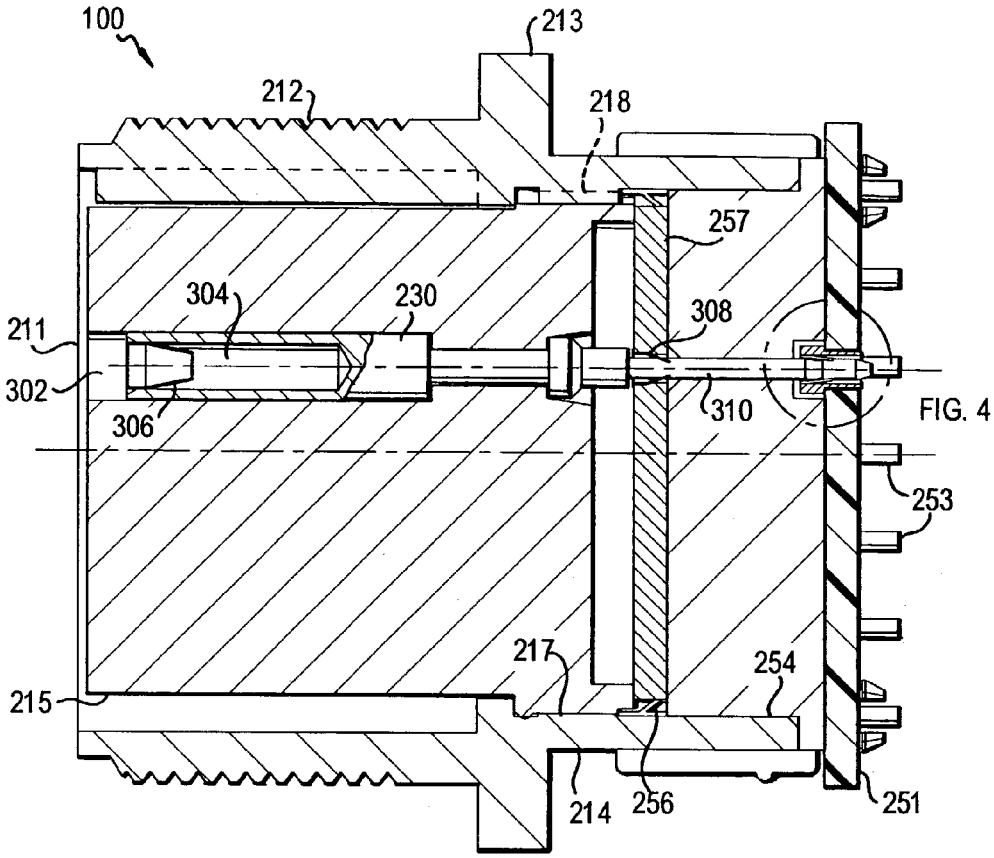
FIG. 3 is a cross-sectional view of the connector of the present invention taken at line 3-3 shown in FIG. 1.

Next, the receptacle 210 includes a rear insert seal 254 with at least one longitudinally-extending insert hole 255 (only the rear opening of the hole 255 is shown). In the embodiment shown in FIG. 2, the outside diameter of the rear insert seal 254 is the same as the outside diameter of the rear shell 215 (as best seen in FIG. 3) and forms a seal for the opening at the rear of the rear shell 215. The rear insert seal 254 will have one insert hole 255 axially-aligned with each contact hole 216 and aperture 258. In FIG. 2, only one insert hole 255 is shown for clarity. The rear insert seal 254 is preferably made of rubber, silicon rubber or similar material that is compressible and resilient.

Also shown in FIG. 2 is a contact 230. The contact 230 provides the interconnectivity function between the receptacle 210 and the printed circuit board assembly 120, both in terms of mechanical retention and electrical continuity. Specifically, the contact 230 provides the means for conducting electrical signals from the electrical conductors associated with the mating plug (not shown) to the electrical circuit traces associated with the printed circuit board assembly 120. The contact 230 also, by connection to the chip capacitor board 257 and through the retainer spring 256 provide selective filtering with various capacitors between pin and connector shell. It also provides the means for attaching and retaining the receptacle assembly 110 to the printed circuit board assembly 120 (described below). The contact 230 is preferably secured inside the contact hole 216 by heat-activated adhesive and/or interference friction contact with the wall of the contact hole 216.

The components of the printed circuit board assembly 120 include the following. First, the printed circuit board assembly 120 includes a printed circuit board 251. Integral to the printed circuit board 251 are one or more contact receptacles 252 and conductors 253. In the embodiment shown in FIG. 2, the number of contact receptacles 252 and conductors 253 is fourteen, which is the number specified for filter connectors according to MIL-C-5015, size 20, and are fully mateable with, for example, plugs made in accordance with MIL-C-5015. Of course, other plugs and sockets having different sizes and numbers of conductors is contemplated without deviating from the nature and scope of the invention.

The contact receptacles 252 are electrically conducting through holes electrically connected to circuits integral to the printed circuit board 251. There will be one contact receptacle 252 axially-aligned with a corresponding contact hole 216, aperture 258 and insert hole 255. The contact receptacles 252 can be conventional through holes well known in the art. However, in the embodiment shown in FIG. 2, the contact receptacles 252 are pin receptacles made by Mill-Max, Oyster Bay, N.Y. The circuits of the printed circuit board 251 are electrically connected to a female plug receptacle 259 that is mateable with the plug or connector of, for example, a ribbon cable.

Turning now to FIG. 3, there is illustrated a cross-sectional view of the connector 100 taken along cross-sectional line 3-3 shown in FIG. 1 (for clarity, only one contact 230 is shown in cross-section). Shown in FIG. 3 is contact hole front opening 302, which provides access to the contact cavity 304. As described above, the contact cavity 304 receives an electrical conductor associated with a plug (not shown). The conductor, when inserted, maintains conductivity in the contact cavity 304 by a cavity spring 306. The cavity spring 306 longitudinally extends from a forward edge of the contact cavity 304 radially inward toward the center of the cavity 304. Cavity spring 306 may be a cantilevered spring or other device that provides an interference fit connection with the conductors from the mating plug.

FIG. 3 also shows chip capacitor board spring 308 that aligns and provides electrical connection for the contact 230 in the chip capacitor board aperture 258 (as best seen in FIG. 2). FIG. 3 also shows a contact tail 310 of the contact 230 that longitudinally extends from the chip capacitor board aperture 258 to the contact receptacle 252.

Figure 4:
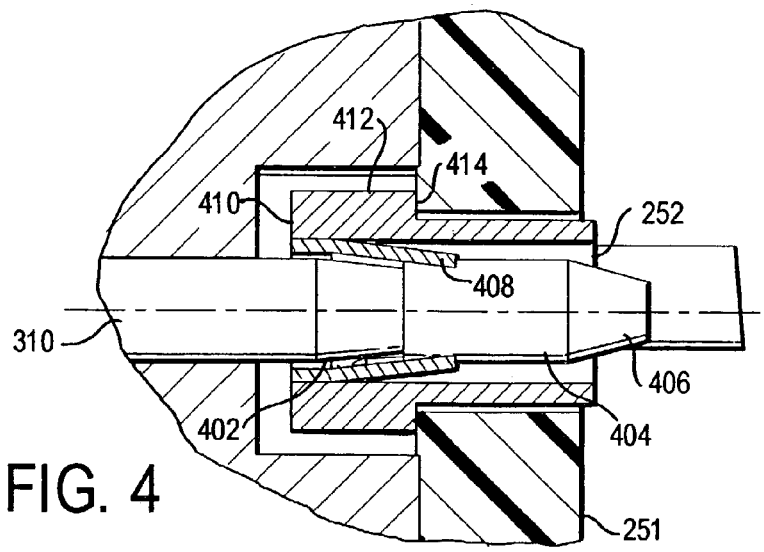
FIG. 4 is an enlarged, partial, cross-sectional view of the contact component of the present invention shown partially inserted in the contact receptacle component of the invention.

In FIG. 4 there is illustrated an enlarged, partial, cross-sectional view of the contact tail 310 of the contact 230 partially inserted in the contact receptacle 252. The contact receptacle 252 is soldered to the printed circuit board 251 and consists of two basic parts. First, the contact receptacle 252 is formed from a cylindrical contact receptacle housing 410, which has a uniform diameter through hole into which the contact tail 310 is inserted. The front half of the contact receptacle housing 410 includes a flange 412 that extends perpendicular relative to the axis of the through hole and forms a shoulder 414 that mates with the top surface of the printed circuit board 251. The rear half of the contact receptacle housing 410 forms a neck or bore with an inside diameter larger than the outside diameter of the contact tail 310.

The contact tail 310 shown in FIG. 4 has an undercut 402. The undercut is machine milled to form a tapered portion of reduced diameter compared to the diameter of the contact tail 310. At the very tip of the contact tail 310 is a tapered contact guide section 406, which provides the function of guiding the contact 230 into the contact receptacle housing 410 during insertion of the contact tail 310.

Figure 5:
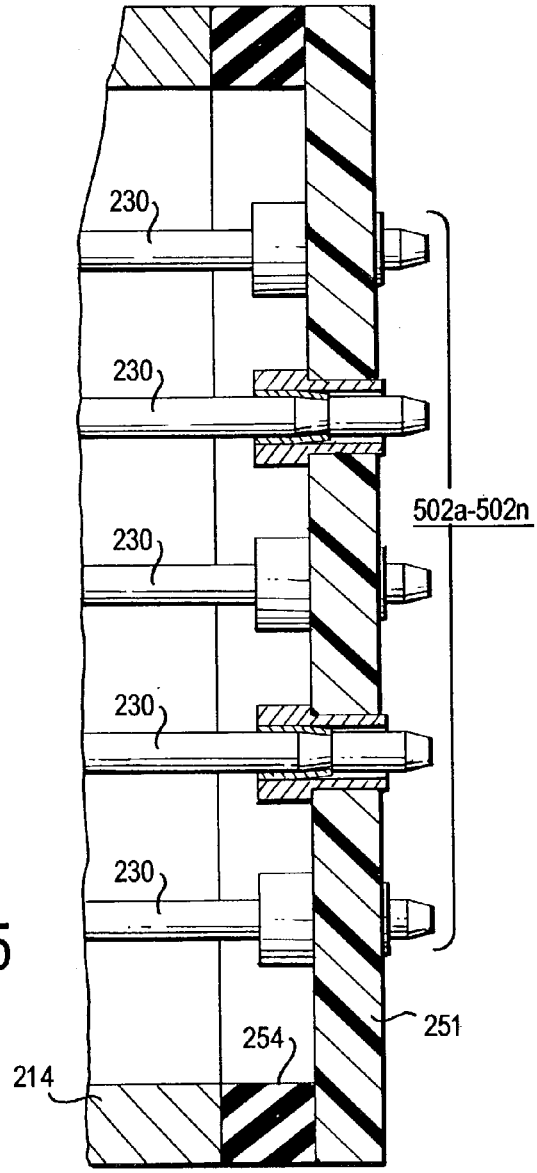
FIG. 5 is another enlarged, partial, cross-sectional view of the present invention showing multiple contacts.

As shown in FIG. 4, the contact tail 310 is partially inserted into the receptacle housing 410. At the point of insertion shown, the contact tail 310 contacts conductive receptacle springs 408 (only one shown). The contact receptacle springs 408 provide the electrical conductivity from the contact tail 310 to the contact receptacle housing 410 and then to the electrical circuit traces (not shown) in the printed circuit board 251. The receptacle springs 408 may be made of a resilient material and are attached to the contact receptacle housing 410 formed in a cantilevered manner as shown in FIG. 4. The ends of the receptacle springs 408 will drop into the undercut 402 when the contact tail 310 is inserted to a point where the undercut 402 passes the ends of the springs 408 in the contact receptacle housing 410 as shown in FIG. 5. In this position, the ends of the receptacle spring 408 abut the undercut 402 on the contact tail 310 to lock the contact tail 310 in place and prevent longitudinal movement opposite the direction of insertion. Since the compressible and resilient rear insert seal 254 abuts the back of the rear shell 214 and the back of the chip capacitor board 257, and the chip capacitor board 257 abuts against the back of the socket insert 215, and because the socket insert 215 securely holds the contact 230, the rear insert 254 thus acts to prevent further insertion of the contact tail 310 in the contact receptacle 252. Therefore, the springs 408 fitted into the undercut 402 and rear insert 254 perform the function of preventing the contact tail 310 from longitudinal movement relative to the contact receptacle 252.

In FIG. 5 there is illustrated another enlarged, partial, cross-sectional view of the present invention taken along line 5,5 of FIG. 1 showing multiple contacts. In the embodiment of the invention shown in FIG. 1 and FIG. 5, and as described above, there are fourteen contacts 230 arranged in rows in a circular pattern as best seen in FIG. 2. In the partial cross-sectional view of FIG. 5, the fourteen contacts 502*a*, 502*b*, 502*c*, . . . 502*n* are shown arranged in five rows.

As shown in FIG. 5, the rear insert seal 254 is between the printed circuit board 251 and the rear shell 214. The flexibility of the rear insert seal 254 material (i.e., rubber, or the like), helps to alleviate propagation of vibrational forces from the receptacle assembly 110 to the printed circuit board assembly 120 and vice versa. This is important to ameliorate stresses imparted on the components that could cause failure or performance degradation over time. The rear insert seal 254 also seals the opening of the rear shell 214.

The method of assembling the above components involves the following steps. First, an appropriate amount of heat-activated adhesive is applied to the shaft of the contact 230 and inner surface of the rear shell 214 and allowed to dry. The alignment groove 218 on the retainer ring 217 is lined up with the alignment flange (not shown) on the rear shell 214 and then the socket insert 215 is slid inside the receptacle 210 until the forward edge of the socket insert 215 is aligned approximately with the forward edge of the front shell 212. The contacts 230 are then assembled in the socket insert 215 by inserting the contacts 230 through the contact holes 216. The adhesive is then heat cured for an appropriate amount of time. After curing, the chip capacitor board 257 is slid over the contact tails 310 of the contacts 230 until it bottoms on the socket insert 215. Then the retainer spring 256 is assembled around the chip capacitor board 257 until it bottoms on the rear of the socket insert 215. Next, the rear insert 254 is slid over the contact tails 310 of the contacts 230 until the shoulder bottoms on the rear face of the rear shell 214. Finally, the printed circuit board assembly 120 is attached by lining up the contact receptacles 252 with the contact tails 310 of the contacts 230 and applying pressure until the receptacle springs 408 click into the contact tail undercuts 402 and the printed circuit board assembly 120 is secured.

Although certain presently preferred embodiments of the present invention have been specifically described and shown herein, it will be apparent to those skilled in the art to which the invention pertains that many variations and modifications of the various embodiments shown and described herein may be made in light of the above teachings without departing from the spirit and scope of the invention. Accordingly, it is intended that the invention be limited only to the extent required by the appended claims and the applicable rules of law.

What is claimed is:

1. An apparatus for electrically and mechanically connecting a printed circuit board to a socket, the apparatus comprising:

a connector member comprising a shell and an insert disposed interiorly of said shell, wherein said insert has at least one longitudinally extending through hole;

at least one electrical contact disposed interiorly through said through hole, said electrical contact comprising a tail portion adjacent the distal end of said electrical contact and wherein said tail comprises an undercut formed substantially circumferentially around said distal end of said tail; and a printed circuit board comprising at least one contact receptacle, wherein said contact receptacle comprises a resilient conductive member and a longitudinally extending conducting through hole, wherein said conducting through hole is axially aligned with said through hole in said insert, and wherein a first end of said resilient member is attached to and longitudinally extends from a front edge of said contact receptacle inwardly and rearwardly toward the longitudinal axis of said contact receptacle and wherein the other end of said resilient member engages a shoulder of said undercut on said tail.

2. The apparatus of claim 1, wherein said resilient member is one of a cantilevered spring and lance.

3. The apparatus of claim 1, further comprising a seal covering the rear edge of said shell and the rear face of said insert.

4. The apparatus of claim 1, further comprising a chip capacitor board electrically connected to said electrical contact.

5. The apparatus of claim 1, wherein said apparatus has a filtering capacitance greater than about 10 picofarads and a working voltage ranging up to about 225 volts.

6. The apparatus of claim 1, further comprising a spring for securing said insert inside said plug socket.

7. The apparatus of claim 1, further comprising a flange extending from said shell.

8. The apparatus of claim 1, wherein said plug socket is adaptable for receiving a size 20, fourteen-conductor plug associated with an electrical cable.

9. The apparatus of claim 1, wherein said printed circuit board further comprises a socket for receiving a ribbon cable.

10. An apparatus for electrically and mechanically connecting a printed circuit board to a socket, the apparatus comprising:

a plug socket comprising a shell and an insert disposed interiorly of said shell, wherein said insert has at least one longitudinally extending through hole;

at least one electrical contact disposed interiorly through said through hole, said electrical contact comprising an undercut formed substantially circumferentially around said electrical contact adjacent the distal end of said electrical contact, wherein said electrical contact is adaptable to receive an electrical conductor of a plug on one end;

a chip capacitor board electrically connected to said electrical contact;

a seal covering the rear edge of said shell and the rear face of said insert;

a printed circuit board comprising at least one contact receptacle, wherein said contact receptacle comprises a resilient member and a longitudinally extending conducting through hole formed by the interior wall of said contact receptacle, wherein said conducting through hole is axially aligned with said through hole in said insert, and wherein a first end of said resilient member is attached to and longitudinally extends from a front edge of said contact receptacle inwardly and rearwardly toward the longitudinal axis of said contact receptacle.

11. The apparatus of claim 10, wherein the other end of said resilient member engages the shoulder of said undercut on said electrical contact, and whereby said resilient member and said seal restrict longitudinal displacement of said contact in said conducting through hole.

12. The apparatus of claim 10, wherein said resilient member is one of a cantilevered spring or lance.

13. The apparatus of claim 10, wherein said apparatus has a filtering capacitance greater than about 10 picofarads and a working voltage ranging up to about 225 volts.

14. The apparatus of claim 10, wherein said plug socket is adaptable for receiving a size 20, fourteen-conductor plug associated with an electrical cable.

15. The apparatus of claim 10, further comprising a spring for securing said shell insert inside said plug socket and a flange extending from the outside surface of said shell.

16. An interconnect device for connecting two plug connectors, the interconnect comprising:

a first plug socket comprising a shell and a shell insert;

an electrical contact secured inside said shell insert, wherein said electrical contact comprising an undercut adjacent its distal end;

a chip capacitor board electrically connected to said electrical contact;

a spring for securing said chip capacitor board inside said shell;

a compressible seal covering the rear of said shell and the rear face of said shell insert;

a printed circuit board comprising a contact receptacle, wherein said contact receptacle comprises a resilient member attached on one end to the inside of a longitudinally extending conducting through hole formed by the interior wall of said contact receptacle, and wherein said spring engages said undercut to retain said printed circuit board to said first plug socket; and a second plug socket connected to said printed circuit board.

17. The interconnect device of claim 16, wherein said electrical contact conducts electricity between a conductor of a first plug inserted in said first plug socket and a conductor of a second plug inserted in said second plug socket.

18. The interconnect device of claim 16, wherein said chip capacitor board and said printed circuit board have a filtering capacitance greater than about 10 picofarads and a working voltage ranging up to about 225 volts.

19. The interconnect device of claim 16, further comprising a longitudinally extending through hole in said shell insert for holding said electrical contact in spaced relationship to said shell insert, wherein said through hole is axially aligned with said conducting through hole in said printed circuit board.

20. The interconnect device of claim 16, wherein a first end of said resilient member is attached to and longitudinally extends from a front edge of said contact receptacle inwardly and rearwardly toward the longitudinal axis of said contact receptacle.

21. The interconnect device of claim 20, wherein said resilient member is a spring.

22. An interconnect device for an electrical signal filtering connection between two plug connectors, the interconnect device comprising:

first socket means for retaining a first plug connector;

a chip capacitor board electrically connected to said first socket means for processing electrical signals;

a printed circuit board electrically connected to said first socket means and said chip capacitor board for processing electrical signals;

second socket means connected to said printed circuit board for retaining a second plug connector; and contact means for securely electrically connecting said first and second plug connectors, whereby said contact means prevents disconnection of the first and second plug connectors.

23. The interconnect of claim 22, wherein said contact means comprises a head, a longitudinally-extending first shaft portion adjacent said head, an axially-extending cavity inside said first shaft portion, a longitudinally-extending second shaft portion adjacent said first shaft portion, a tail portion adjacent said second shaft portion, and an undercut disposed substantially circumferentially around said distal end of said tail portion.

24. The interconnect of claim 23, wherein said printed circuit board includes a longitudinally extending conducting through hole and a resilient member attached on one end to the inside of said conducting through hole, wherein said resilient member engages said undercut to retain said printed circuit board to said first socket means.

25. An electrical connector for connecting a printed circuit board to a socket, the connector comprising:

a plug socket comprising a shell and an insert disposed inside said shell, wherein said insert has at least one longitudinally extending through hole;

at least one electrical contact disposed inside said through hole;

a printed circuit board comprising at least one contact receptacle, wherein said contact receptacle comprises a longitudinally extending conducting through hole formed by the interior walls of said contact receptacle, wherein said conducting through hole is axially aligned with said through hole in said insert; and undercut means for securing said electrical contact to said printed circuit board, whereby said electrical contact is prevented from reversibly retreating from said through hole of said printed circuit board.

26. The connector of claim 25, wherein said undercut means comprises a resilient spring or lance longitudinally extending from a front edge of said contact receptacle inwardly toward the longitudinal axis of said contact receptacle in a cantilevered manner, and an undercut formed substantially circumferentially around said electrical contact adjacent the distal end of said electrical contact.

27. The connector of claim 25, wherein said electrical contact comprises a head, a longitudinally-extending first shaft portion adjacent said head, an axially-extending cavity inside said first shaft portion, a longitudinally-extending second shaft portion adjacent said first shaft portion, a tail portion adjacent said second shaft portion, and an undercut disposed substantially circumferentially around said distal end of said tail portion.

* * * * *